United States Patent [19]

Malarkey et al.

[11] 4,163,139

[45] Jul. 31, 1979

[54] COOKING VESSEL CAPACITIVE DECOUPLING FOR INDUCTION COOKING APPARATUS

[75] Inventors: Terence D. Malarkey, Monroeville; William C. Moreland, II, Export, both of Pa.

[73] Assignee: White Consolidated Industries, Inc., Cleveland, Ohio

[21] Appl. No.: 290,045

[22] Filed: Sep. 18, 1972

[51] Int. Cl.[2] ..... H05B 5/04

[52] U.S. Cl. ..... 219/10.49 R; 174/5 SG; 336/84 M; 361/212; 219/10.75

[58] Field of Search ..... 219/10.49, 10.75, 10.77, 219/10.79; 336/84, 84 M; 317/2, 2 G; 174/5, 51, 35 MS, 5 SG; 338/32, 64; 361/212

[56] References Cited

U.S. PATENT DOCUMENTS

| | | | |
|---|---|---|---|
| 1,909,982 | 5/1933 | Parker | 219/10.79 |
| 2,047,159 | 7/1936 | Wood et al. | 336/84 X |
| 2,321,587 | 6/1943 | Davie et al. | 174/35 MS |
| 2,388,848 | 11/1945 | Howe | 174/35 MS |
| 3,132,065 | 5/1964 | Barsy et al. | 317/2 G |
| 3,697,716 | 10/1972 | Kornrumpf | 219/10.49 |
| 3,710,062 | 1/1973 | Peters | 219/10.49 |
| 3,781,503 | 12/1973 | Harnden et al. | 219/10.49 |
| 3,823,296 | 7/1974 | Amagami et al. | 219/10.49 |
| 3,898,410 | 8/1975 | Peters | 219/10.77 |

*Primary Examiner*—Bruce A. Reynolds
*Attorney, Agent, or Firm*—Pearne, Gordon, Sessions, McCoy & Granger

[57] ABSTRACT

In an induction cooking apparatus, an electrostatic shield is interposed between the work coil and the location of the cooking vessel upon the sheet forming a cook top to reduce the capacitive coupling between the coil and the cooking vessel to accordingly reduce the voltage between the vessel and ground.

11 Claims, 4 Drawing Figures

COOKING VESSEL CAPACITIVE DECOUPLING FOR INDUCTION COOKING APPARATUS

BACKGROUND OF THE INVENTION

1. Field of the Invention

This invention pertains to the art of induction heating cooking apparatus and in particular to electrostatically shielding the cooking vessel in a manner to reduce capacitive coupling between the work coil and the vessel without significantly affecting the inductive coupling between the coil and vessel.

2. Description of the Prior Art

We are unaware of teachings pertaining to our invention in the art of induction cooking apparatus.

U.S. Pat. No. 3,806,688 filed Apr. 13, 1972, and the companion U.S. patent applications referred to therein disclose a circuit arrangement useful for an induction heating cooking apparatus. A work coil driven by this circuit is formed by litz wire spirally wound upon itself to form a relatively flat work coil of generally pancake shape, which underlies the glass-ceramic or refractory material cook top. Current through the work coil generates a varying magnetic field in the coil, which field passes readily through the glass-ceramic cook top and produces current and heating in the bottom of the metallic cooking vessel placed on the cook top over the coil.

We have found that a voltage can be measured between the cooking vessel and ground. We analyze this voltage as being derived from the capacitive coupling from the work coil to the cooking vessel since the coil and vessel may be regarded as the plates of the capacitor which has the glass cook top as the dielectric. While it is doubted that the voltages and currents at the frequency at which the work coil operates (about 27 KHz) would be lethal, particularly in view of the current being limited by the effective capacitance value, the voltage is sufficient to cause an annoying tingle to anyone who touches the metallic part of the cooking vessel. Such a tingle could cause one who is lifting a vessel with hot contents to drop the pan and suffer burns from the contents.

It is the aim of our invention to provide an arrangement which reduces the voltage coupled to a cooking vessel sufficiently that the likelihood of a shock or tingle by one touching the cooking vessel is substantially reduced.

SUMMARY OF THE INVENTION

In accordance with our invention, in the environment referred to we provide electrostatic shielding means interposed between the coil and the location of the cooking vessel, the shielding means being comprised of electrically conductive material of a character and arranged to significantly reduce the capacitive coupling between the coil and the vessel without significantly reducing the inductive coupling between the coil and the vessel.

In one currently preferred way of carrying out the invention, a so-called resistive coating is applied to the underside of the cook top sheet, at least over the area thereof between the coil and the cooking vessel position, the resistive coating being connected to ground. In an alternate way of carrying out the invention, a Faraday shield is interposed between the coil and the vessel.

DRAWING DESCRIPTIONS

BRIEF DESCRIPTION OF THE INVENTION

Figure 1:
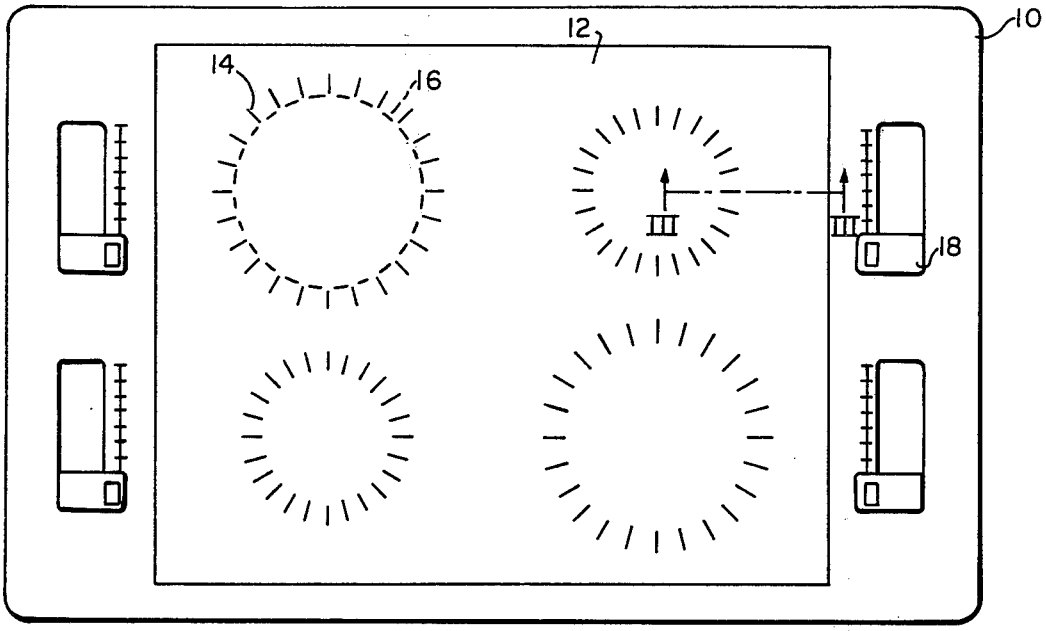
FIG. 1 is a plan view of induction heating cooking apparatus of the character which may incorporate our invention.

As shown in FIG. 1, the induction heating cooking apparatus as viewed from above essentially comprises a generally perimetric frame 10 which supports a cook top sheet 12 of glass-ceramic or other refractory material of a character suitably resistant to shock, and provided with visual indicia 14 for indicating the cooking area and underlying locations of each of the induction work coils 16. A control 18 is provided for each of the cooking areas and may be of the character disclosed in U.S. patent application Ser. No. 217,007 filed Jan. 11, 1972 now U.S. Pat. No. 3,711,672.

Figure 2:
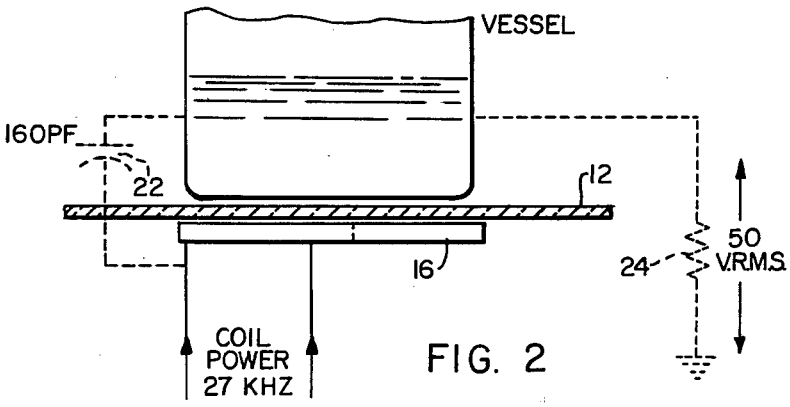
FIG. 2 is a diagrammatic and schematic representation in the nature of a side view illustrating the arrangement which gives rise to the problem solved by our invention.

Referring to FIG. 2, the arrangement by which the cooking vessel 20 is capacitively coupled to the work coil and thereby carries a voltage relative to ground is schematically illustrated. As is disclosed in detail in the noted U.S. Pat. No. 3,806,688, induction work coil 16 is a part of the series resonant circuit in a load circuit of a high frequency (for example, 27 KHz) oscillator which is energized from a controllable DC power source. We have found that a capacitance of 160 pF, indicated by the dashed line capacitance 22, can be measured, with a 1 KHz bridge, between the indicated points in FIG. 2. This of course results from the work coil 16 and vessel 20 functioning as the plates of a capacitor separated by a glass cook top sheet 12 functioning as the dielectric. With such an arrangement, the typical voltage measured from the cooking vessel to ground across a 100 K ohm resistor 24 is 50 volts r.m.s. Similar voltages have been measured across resistances of 1 M ohm and 10 K ohm between the cooking vessel and ground.

Figure 3:
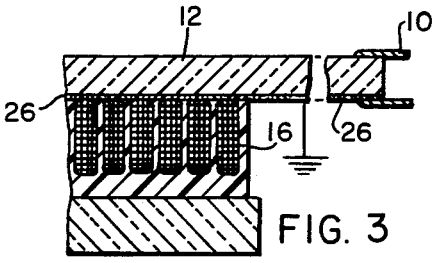
FIG. 3 is a partly-broken cross-section corresponding to one taken along the line III—III of FIG. 1.

In accordance with our invention, we reduce this voltage between the cooking vessel and ground by providing electrostatic shielding means interposed between the coil and the cooking vessel. The electrostatic shielding means reduces the capacitive coupling between the coil and vessel, and accordingly reduces the voltage between the vessel and ground without significantly reducing the inductive coupling between the coil and vessel. The preferred way to effect the reduction of the capacitive coupling is to apply a so-called resistive coating to the underside of the glass sheet 12, at least in the area coextensive with the diameter of the work coil 16, and connect this coating with ground. The resistive coating applied to the underside of the sheet 12 is indicated in FIG. 3 by the heavy line 26. Resistive coatings of several different values have been tried with satisfactory results. Electro-Dag-3 having a value of 4 K ohms per square applied in a 1 mil thickness provided a good reduction of the capacitive coupling when applied to the entire lower surface of the cook top 12 and grounded to the frame 10 of the cooking apparatus as indicated in FIG. 3. Aquadag E, which has a resistivity value of about 25 ohms per square at a 1 mil thickness, provided a somewhat better reduction of the capacitive coupling when applied to the entire undersurface of the cook top sheet 12 and grounded as indicated before through the frame 10. These resistive coatings can be obtained from the Acheson Colloids Company of Port Huron, Mich. Since satisfactory reduction in the capacitive coupling and accordingly the voltage from the vessel to the ground was obtained with the disparate resistivity values, it was found that a wholly satisfactory result could be obtained by applying the Aquadag-E coating with an ordinary paint brush and then permitting it to air dry, as distinguished from the rather complex technique recommended to obtain a highly accurate coating thickness. For economic reasons therefore, the currently preferred method is to apply the Aquadag-E with an ordinary paint brush to the entire underside of the cook top sheet 12, and then permit the coating to air dry.

In this connection it is noted that the particular resistance value of the coating is not critical within reasonable limits. With a reduction in the resistivity value of the coating there is a corresponding reduction in the voltage between the vessel and ground, but an increase in the heating of the coating. With the Aquadag-E coating applied as noted, the reduction in the voltage across the 100 K ohms resistance has been reduced to 6 volts r.m.s. It would be expected that lower voltages could be obtained by using resistivity values of less than that obtained with the Aquadag-E coating. However, because of the tendency for the coating itself to become warmer with lower resistivity values, the desired reduction in the voltage between the vessel and the ground is balanced against the extent to which the coating itself heats and transfers the heat to the glass cook top sheet 12.

Figure 4:
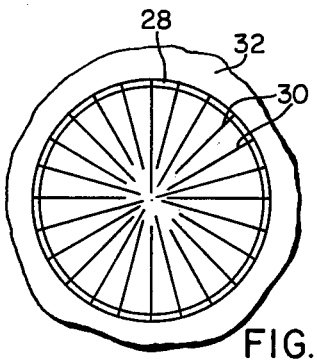
FIG. 4 is a plan view of one form of Faraday shield according to the invention.

Another way of carrying out our invention will be explained in connection with FIG. 4 in which the Faraday shield 28 is shown. This shield may be formed by providing a series of radial fingers 30 from a highly conductive material, such as copper, on a base 32 which may be a thin printed circuit board, and connecting the radially outer ends of all of the fingers in a ring. The provision of the radial fingers with their outer ends being connected and their inner ends unconnected, is for the purpose of minimizing eddy currents in the material to avoid undue heating. The Faraday shield so constructed on the printed circuit board is then located against the underside of the cook top sheet 12 and overlying the work coil 16, and the outer ring of the shield is connected to ground. The Faraday shield worked satisfactorily, but even with the arrangement shown the eddy currents had a slightly adverse effect upon the oscillator performance. Also, the shield is relatively expensive to produce as contrasted to the resistive coating indicated as the preferred embodiment of the invention, and results in spacing the work coil slightly farther away from the cooking vessel.

It is also considered to be within the scope of the invention that the resistive coating be applied to the top surface of the cook top sheet 12 so long as it has a sufficient degree of abrasion resistance.

Since it has been empirically determined that the resistive coating applied as taught performs satisfactorily from a practical standpoint, no attempt has been made to determine the optimum resistivity value for the coating. This decision is also based on our belief that a rather complex network from an electrical standpoint is formed by the introduction of the resistive coating. Analysis of the network would be further complicated from the standpoint of the calculations because the coil character and the current circuit arrangement used results in a square waveform at the one lead-in to the coil and a sine wave form at the other lead-in to the coil. Accordingly, substantial time and effort would be required to analyze the network to determine the optimum ohmic value of the resistive coating.

We claim:

1. In an induction heating cooking device including a cook top sheet, and at least one relatively flat work coil underlying said sheet, and through which an alternating current flows to generate a magnetic field for producing current for heating a cooking vessel adapted to be placed on said sheet over said coil, grounded electrostatic shielding means interposed between said coil and the location of said cooking vessel on said sheet, said shielding means being comprised of electrically conductive material of a character and arranged to significantly reduce the capacitive coupling between said coil and said vessel without significantly reducing the inductive coupling between said coil and said vessel.

2. In an induction heating cooking device according to claim 1 wherein:

said electrostatic shielding means comprises a Faraday shield.

3. In an induction heating cooking device according to claim 2 wherein:

said Faraday shield comprises a plurality of spaced apart fingers of highly electrically conductive material, the one end of each of said fingers being connected together.

4. In an induction heating cooking device according to claim 1 wherein:

said electrostatic shielding means comprises an electrically grounded stratum of material of electrically resistive character.

5. In an induction heating cooking device according to claim 4 wherein:

said stratum of material is a coating on the underside of said cook top sheet.

6. In an induction heating cooking device including a cook top sheet of material having a relatively high dielectric constant, and at least one relatively flat work coil underlying said sheet and through which an alternating current flows to generate a magnetic field for producing current for heating in a cooking vessel adapted to be placed on said sheet and over said coil, electrostatic shielding means interposed between said coil and said cooking vessel, said electrostatic shielding means being connected to electrical ground, said shielding means being comprised of electrically conductive material of a character and arranged to significantly reduce the capacitive coupling between said coil and said vessel, and accordingly to reduce the voltage between said vessel and the ground, without significantly reducing the inductive coupling between said coil and said vessel.

7. In a cooking device according to claim 6 wherein:

said electrostatic shielding means comprises a stratum of material of electrically resistive character applied as a coating to said cook top sheet.

8. An induction heating unit for an inductively heated cooking vessel comprising a planar, spirally wound induction heating coil, high frequency inverter circuit means coupled to and exciting said induction heating coil with high frequency electric currents, a flat, insulating support member physically disposed over the induction heating coil for supporting a cooking vessel to be inductively heated by the induction heating coil, and electrostatic shielding means physically disposed intermediate the induction heating coil and the flat insulating supporting member for electrostatically shielding the inductively heated cooking vessel, and grounding means for grounding high frequency electric currents electrostatically induced in the electrostatic shielding means.

9. An induction heating unit according to claim 8, wherein the electrostatic shielding means is physically formed on the under surface of the support member in the form of a conductive surface having at least one common grounding point.

10. An induction heating cooking device comprising a work coil for inductively heating a cooking vessel and electrostatic shielding means interposed between said coil and the location of said cooking vessel, said shielding means being comprised of electrically conductive material of a character and arranged to significantly reduce the capacitive coupling between the coil and the vessel without significantly reducing the inductive coupling between the coil and the vessel.

11. An induction heating cooking device comprising an induction heating work coil and a structure mounted above said coil for supporting a cooking vessel to be heated thereby and for shielding it from a build-up thereon of an electrostatic charge, said structure including electrostatic shield means disposed between the work coil and the location of such vessel, said electrostatic shield means being electrically grounded.

* * * * *